US005480703A

United States Patent [19]

Suematsu

[11] Patent Number: 5,480,703

[45] Date of Patent: Jan. 2, 1996

[54] HEAT-RESISTANT THERMAL TRANSFER RECORDING MEDIUM

[75] Inventor: Hideki Suematsu, Osaka, Japan

[73] Assignee: Fujicopian Co., Ltd., Japan

[21] Appl. No.: 234,534

[22] Filed: Apr. 28, 1994

[30] Foreign Application Priority Data

Apr. 30, 1993 [JP] Japan ..... 5-104650

[51] Int. Cl.[6] ..... B41M 5/26

[52] U.S. Cl. ..... 428/212; 428/195; 428/484; 428/488.1; 428/488.4; 428/500; 428/511; 428/516

[58] Field of Search ..... 428/195, 484, 428/488.1, 488.4, 913, 500, 511, 516, 212, 914

[56] References Cited

U.S. PATENT DOCUMENTS 4,880,324 11/1989 Sato et al. ..... 428/195

5,362,548 11/1994 Hiyoshi et al. ..... 428/484

*Primary Examiner*—Pamela R. Schwartz

*Attorney, Agent, or Firm*—Fish & Neave

[57] ABSTRACT

A thermal transfer recording medium having a wax-type heat-meltable ink layer provided on a foundation wherein the vehicle of the ink layer contains an oxidized polyethylene wax as the major component and the melting point of the ink layer is not lower than 95° C. Also disclosed is a thermal transfer recording medium having a release layer containing a wax as the major component and a resin-type heat-meltable ink layer provided on a foundation in this order wherein the melting point of the release layer is not lower than 90° C. The recording media can be used in a high-temperature environment of about 60° to 90° C.

2 Claims, No Drawings

HEAT-RESISTANT THERMAL TRANSFER RECORDING MEDIUM

BACKGROUND OF THE INVENTION

The present invention relates to a thermal transfer recording medium usable in a high-temperature environment.

A thermal transfer recording medium is used for producing printed images in such a manner wherein the heat-meltable ink layer thereof is selectively heated with a heating device such as a thermal head to melt-transfer heated portions of the ink layer onto a receptor. The thermal transfer recording medium has widely been used in printing devices for word processer, personal computer, etc. There is a possibility that the thermal transfer recording medium is used in a high-temperature environment wherein the temperature rises to 60° C. or higher, such as the tropics.

However, a conventional thermal transfer recording medium is unusable in such a high-temperature environment.

The conventional thermal transfer recording medium includes a wax-type one wherein the vehicle of the heat-meltable ink layer is composed mainly of a wax, and a resin-type one wherein the vehicle of the heat-meltable ink layer is composed of a wax and a resin in combination.

Generally most waxes have a melting point of about 60° to 80° C. Therefore, the wax-type thermal transfer recording medium is apt to be unusable in the above-mentioned high-temperature environment because the ink layer assumes a softened or flowing state during transportation, storage or use.

In the case of the resin-type thermal transfer recording medium, the ink layer per se does not cause any problem because the ink layer has a high melting or softening point. However, when the ink layer is provided directly on the foundation, the ink layer exhibits great adhesion to the foundation when transferring, resulting in a poor transferability. For that reason, the resin-type thermal transfer recording medium generally requires a release layer between the foundation and the ink layer. The release layer is generally composed mainly of a wax, which makes the resin-type medium unusable in the high-temperature environment.

In view of the foregoing, it is an object of the present invention to provide a thermal transfer recording medium which is usable in a high-temperature environment.

This and other objects of the present invention will become apparent from the description hereinafter.

SUMMARY OF THE INVENTION

According to a first aspect of the present invention, there is provided a heat-resistant thermal transfer recording medium comprising a foundation, and a heat-meltable ink layer provided on the foundation and comprising a vehicle and a coloring agent, the vehicle containing 50 to 100 parts by weight of an oxidized polyethylene wax per 100 parts by weight of the vehicle, the heat-meltable ink layer having a melting point of not lower than 95° C.

According to a second aspect of the present invention, there is provided a heat-resistant thermal transfer recording medium comprising a foundation, a release layer provided on the foundation and comprising a wax as the major component, and a heat-meltable ink layer provided on the release layer and comprising a vehicle and a coloring agent, the vehicle comprising a wax and 10 to 50 parts by weight of a heat-meltable resin per 100 parts by weight of the vehicle, the release layer having a melting point of not lower than 90° C., and the heat-meltable ink layer having a melting or softening point of not lower than 95° C.

DETAILED DESCRIPTION

The first aspect of the present invention relates to a thermal transfer recording medium having a wax-type ink layer, characterized in that the vehicle of the heat-meltable ink layer contains 50 to 100 parts by weight of an oxidized polyethylene wax per 100 parts by weight of the vehicle, and the heat-meltable ink layer has a melting point of not lower than 95° C.

The heat-meltable ink layer has a melting point of not lower than 95° C. because the major component of the vehicle is an oxidized polyethylene wax having a high melting point. The ink layer does not become softened or fluid even in a high-temperature environment of about 60° to 90° C. and, hence, is usable in such a high-temperature environment.

Even though the ink layer is of wax-type, it exhibits good adhesion to the foundation because the major component of the vehicle is an oxidized polyethylene wax, which prevents the so-called "falling of ink".

Herein, the terminology "falling of ink" means a phenomenon wherein an ink layer is peeled off in a powder form from a foundation by action of a slight external force during traveling of the ink ribbon or the like due to a poor adhesion of the ink layer to the foundation.

The heat-meltable ink layer wherein the major component of the vehicle is an oxidized polyethylene wax is hard, so that smearing of a receptor is prevented.

The second aspect of the present invention relates to a thermal transfer recording medium having a resin-type ink layer, characterized in that the release layer contains a wax as the major component and has a melting point of not lower than 90° C., and the vehicle of the heat-meltable ink layer contains a wax and 10 to 50 parts by weight of a heat-meltable resin per 100 parts by weight of the vehicle and the heat-meltable ink layer has a melting or softening point of not lower than 95° C.

According to the second aspect of the present invention, the release layer has a high melting point of not lower than 90° C. even though the major component is a wax, so that it does not become softened or fluid even in a high-temperature environment of about 60° to 90° C.

The release layer is preferably composed of a polyethylene wax. Such a release layer exhibits a good releasability when transferring because the polyethylene wax exhibits less adhesion to the foundation when transferring, which makes it possible to use a resin-type ink layer in the high-temperature environment. Of course, the release layer composed of a polyethylene wax, when not being heated, exhibits adhesion to the foundation enough to prevent the falling of ink.

In the resin-type ink layer in the second aspect, there is preferably used an oxidized polyethylene wax having a high melting point as a wax component, which ensures a good heat-resistance and smear-resistance of the resin-type ink layer.

The first aspect of the present invention will be explained specifically.

The heat-meltable ink layer in the first aspect is composed of a coloring agent and a heat-meltable vehicle, the vehicle containing 50 to 100 parts by weight of an oxidized polyethylene wax per 100 parts by weight of the vehicle. The ink layer has a melting point of not lower than 95 ° C.

The oxidized polyethylene wax is a wax derived from a polyethylene wax and obtained by oxidizing a polyethylene wax with air or other oxidizing agent to introduce thereinto polar functional groups such as carboxyl group or hydroxyl group. An oxidized polyethylene wax wherein at least one polar functional group is introduced in the carbon chain of the polyethylene wax is satisfactorily used. The preferred oxidized polyethylene wax contains polar functional groups introduced to 1 to 10% of the carbon atoms of the carbon chain in terms of average number.

Such an oxidized polyethylene wax has characteristic properties such as an effect of improving dispersibility of a coloring agent and an improved adhesion to the foundation in addition to its high melting point.

Usable as the oxidized polyethylene wax are those having a melting point of not lower than 95° C. The use of an oxidized polyethylene wax having a melting point of lower than 95° C. lowers the heat resistance of the ink layer.

Examples of commercially available oxidized polyethylene wax include CP-540 made by Allied Signal Inc., Hi-wax 220MP made by Mitsui Petrochemical Industries, Ltd., Sanwax E-300 made by Sanyo Chemical Industries, Ltd.

The oxidized polyethylene wax is contained in the vehicle in an amount of 50 to 100 parts (parts by weight, hereinafter the same) per 100 parts of the vehicle. When the content of the oxidized polyethylene wax is less than the above range, the heat-resistance of the ink layer is lowered.

The vehicle may contain one or more other waxes. Examples of such waxes are include natural waxes such as haze wax, bees wax, carnauba wax, candelilla wax, montan wax and ceresine wax; petroleum waxes such as paraffin wax and microcrystalline wax; synthetic waxes such as oxidized wax, ester wax, polyethylene wax, Fischer-Tropsch wax and α-olefin-maleic anhydride copolymer wax; higher fatty acids such as myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These waxes may be used either alone or in combination. Among these waxes, there are preferably used waxes having a high melting point, such as polyethylene wax and microcrystalline wax.

Usable as the aforesaid coloring agent are any coloring agents conventionally used in a heat-meltable ink of this type. Examples of such coloring agents include various inorganic or organic pigments or dyes as well as carbon black. The content of the coloring agent in the ink layer is usually about 5 to 25% by weight, preferably about 5 to 15% by weight.

If necessary, the ink layer may be incorporated with a small amount of a resin, or an additive such as dispersing agent or antistatic agent.

The melting point of the ink layer is not lower than 95° C., preferably from 95° to 110° C. When the melting point is lower than the above range, the heat-resistance of the ink layer is insufficient. When the melting point is higher than the above range, the transferability of the ink layer is apt to degrade.

The coating amount (on a dry weight basis) of the ink layer is preferably about 1 to 6 g/m$^2$.

Usable as the foundation are polyester films such as polyethylene terephthalate film, polyethylene naphthalate film, polyarylate film and polybutylene terephthalate film, polycarbonate films, polyamide films, aramid films and other various plastic films commonly used for the foundation of an ink ribbon of this type. Thin paper sheets with a high density such as condenser paper can also be used. From the viewpoint of improving heat conduction, the thickness of the foundation is preferably within the range of about 1 to 10 μm, more preferably about 2 to 7 μm.

When the aforesaid plastic film is used as the foundation, the back side (the side adapted to be brought into slide contact with the thermal head) of the foundation may be provided with a conventionally known stick-preventive layer composed of one or more of various heat-resistant resins such as silicone resin, fluorine-containing resin, nitrocellulose resin, other resins modified with these heat-resistant resins including silicone-modified acrylic resins, and mixtures of the foregoing heat-resistant resins and lubricating agents.

Then, the second aspect of the present invention will be explained specifically.

The release layer in the second aspect contains a wax as the major component and has a melting point of not lower than 90° C. The content of the wax in the release layer is preferably from 50 to 100% by weight.

As the wax for the release layer, there is preferably used a polyethylene wax to ensure a high melting point. Generally polyethylene waxes have a high melting point. A polyethylene wax having a melting point of about 95° to 110 ° C. is preferably used in the release layer.

The content of the polyethylene wax in the release layer is preferably from 60 to 100 parts per 100 parts of the wax. When the content of the polyethylene wax is lower than the above range, the heat-resistance of the release layer is apt to be lowered.

The release layer may be incorporated with one or more other waxes. Usable as such waxes are those exemplified for the vehicle of the ink layer in the first aspect of the present invention. Waxes having a high melting point, such as carnauba wax and microcrystalline wax, are preferably used.

The melting point of the release layer is not lower than 90° C., preferably from 90° to 110° C. When the melting point is lower than the above range, the heat-resistance is insufficient. When the melting point is higher than the above range, the releasing property degrades.

The coating mount of the release layer is preferably about 0.1 to 2 g/m$^2$.

The ink layer in the second aspect of the present invention is composed of a coloring agent and a vehicle containing a wax and a heat-meltable resin as the essential components. The heat-meltable resin is contained in an mount of 10 to 50 parts per 100 parts of the vehicle. The melting point of the ink layer is not lower than 95° C. When the mount of the heat-meltable resin is smaller than the above range, the characteristic property as a resin-type ink, i.e. having a high melting or softening point, degrades. When the mount of the heat-meltable resin is larger than the above range, the selective transferability of the ink layer degrades.

The vehicle preferably contains 50 to 90 parts of a wax per 100 parts of the vehicle. As the wax for the ink layer in the second aspect of the present invention, there is preferably used an oxidized polyethylne wax having a melting point of not lower than 95° C. Usable as such an oxidized polyethylene wax are those exemplified for the vehicle of the ink layer in the first aspect of the present invention.

The oxidized polyethylene wax is preferably used in an amount of 50 to 100 parts per 100 parts of the whole wax in the ink layer. When the amount of the oxidized polyethylene wax is smaller than the above range, the heat-resistance of the ink layer and the dispersibility of the coloring agent are apt to degrade.

One or more other waxes may be used in combination with the oxidized polyethylene wax. Usable as such waxes are those exemplified for the vehicle of the ink layer in the first aspect of the present invention. There are preferably used waxes having a high melting point such as polyethylene wax and microcrystalline wax.

Examples of the aforesaid heat-meltable resin (including elastomer) include olefin copolymer resins such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenolic resins, styrene resins, vinyl acetate resins, natural rubber, styrene-butadiene rubber, isoprene rubber, chloroprene rubber, polyisobutylene and polybutene. These heat-meltable resins may be used either alone or in combination.

If necessary, the ink layer may be incorporated with an additive such as dispersing agent or antistatic agent.

The melting or softening point of the ink layer is not lower than 95° C., preferably from 95° to 110° C. When the melting or softening point of the ink layer is lower than the above range, the heat-resistance of the ink layer is insufficient. When the melting or softening point of the ink layer is higher than the above range, the transferability of the ink layer degrades.

The coating amount of the ink layer is preferably from about 1 to 5 g/m$^2$.

Usable as the coloring agent and the content thereof for the ink layer in the second aspect of the present invention are those for the ink layer in the first aspect.

The foundations exemplified for the first aspect of the present invention can be used in the second aspect.

The present invention will be described in more detail by way of examples thereof. It is to be understood that the present invention is not limited to these examples, and various changes and modifications may be made in the invention without departing from the spirit and scope thereof.

EXAMPLE 1

A polyethylene terephthalate (PET) film with a thickness of 3 μm was used having a stick-preventive layer composed of a silicone-modified urethane resin in a thickness of 0.1 μm on one side thereof. Onto the other side of the PET film was coated the below-mentioned coating liquid for ink layer, followed by drying to form an ink layer having a melting point of 95° C. in a coating amount of 3 g/m$^2$.

| Components | Parts |
|---|---|
| Oxidized polyethylene wax (melting point: 95° C.) | 8.5 |
| Polyethylene wax (melting point: 105° C. | 0.5 |
| Carbon black | 1.0 |
| Toluene | 20 |
| Isopropyl alcohol | 70 |

Comparative Example 1

The same procedures as in Example 1 except that the coating liquid for ink layer was changed to the below-mentioned were repeated to give a thermal transfer recording medium wherein the melting point of the ink layer was 77° C.

| Components | Parts |
|---|---|
| Paraffin wax (melting point: 72° C.) | 5.0 |
| Carnauba wax (melting point: 84° C.) | 4.0 |
| Carbon black | 1.0 |
| Toluene | 20 |
| Isopropyl alcohol | 70 |

EXAMPLE 2

Onto the front surface of the same PET film having the sticking-preventive layer on the back surface thereof used in Example 1 was coated the below-mentioned coating liquid for release layer, followed by drying to form a release layer having a melting point of 105° C. in a coating amount of 1 g/m$^2$. Onto the release layer was coated the below-mentioned coating liquid for ink layer, followed by drying to form an ink layer having a melting point of 96.5° C. in a coating amount of 4 g/m$^2$, thus yielding a thermal transfer recording medium.

Coating liquid for release layer

| Components | Parts |
|---|---|
| Coating liquid for release layer | |
| Polyethylene wax (melting point: 110° C.) | 8.0 |
| Microcrystalline wax (melting point: 92° C.) | 2.0 |
| Toluene | 90 |
| Coating liquid for ink layer | |
| Oxidized polyethylene wax (melting point: 95° C.) | 5.0 |
| Polyethylene wax (melting point: 110° C. | 1.0 |
| Ethylene-vinyl acetate copolymer (softening point: 110° C.) | 3.0 |
| Carbon black | 1.0 |
| Toluene | 20 |
| Isopropyl alcohol | 70 |

Comparative Example 2

The same procedures as in Example 2 except that the coating liquid for release layer was changed to the below-mentioned were repeated to give a thermal transfer recording medium wherein the melting point of the release layer was 79° C.

| Components | Parts |
|---|---|
| Paraffin wax (melting point: 78° C. ) | 8.0 |
| Carnauba wax (melting point: 84° C. ) | 2.0 |

-continued

| Components | Parts |
|---|---|
| Toluene | 90 |

Each of the thermal transfer recording media was used in a thermal transfer printer (CH-5400, made by Seiko Instruments Inc.) to continuously print alphabetic and numeric characters on a high-quality paper sheet in an environment of 75° C. The condition of the ruin of the printed images, wherein the lines constituting a character were thickened so that it was difficult or impossible to read the character, was observed by the naked eye, and rated into the following three stages. The results thereof are shown in Table 1.

TABLE 1

| | Ex 1 | Com. Ex. 1 | Ex. 2 | Com. Ex. 2 |
|---|---|---|---|---|
| Ruin of printed image | 3 | 1 | 3 | 1 |

1 . . . A severe ruin occurred and the character was not readable.
2 . . . A little ruin was observed but the character was readable.
3 . . . No ruin was observed.

In addition to the materials and ingredients used in the Examples, other materials and ingredients can be used in the Examples as set forth in the specification to obtain substantially the same results.

As has been described, the thermal transfer recording medium of the present invention can be used in a high-temperature environment of about 60° to 90° C., in both cases of having a wax-type heat-meltable ink layer and a resin-type heat-meltable ink layer provided on a release layer composed of a wax as the major component.

What is claimed is:

1. A heat-resistant thermal transfer recording medium comprising a foundation, a release layer provided on the foundation and a heat-meltable ink layer provided on the release layer, wherein the heat-meltable ink layer comprises a vehicle and a coloring agent, the vehicle comprising a wax and 10 to 50 parts by weight of a heat-meltable resin per 100 parts by weight of the vehicle, the wax comprising 50 to 100 parts by weight of an oxidized polythylene wax per 100 parts by weight of the wax, and the heat-meltable ink layer has a melting or softening point of not lower than 95° C., wherein the release layer comprises 50 to 100 parts by weight of a wax per 100 parts by weight of the release layer, the wax comprising 60 to 100 parts by weight of a polyethylene wax per 100 parts by weight of the wax, and the release layer has a melting point of not lower than 90° C.

2. The heat-resistant thermal transfer recording medium according to claim 1, wherein the melting point of the release layer is from 90° to 110° C.

* * * * *